US009131761B2

(12) United States Patent
Kalyanpur et al.

(10) Patent No.: US 9,131,761 B2
(45) Date of Patent: Sep. 15, 2015

(54) MULTI-COMPARTMENT CONTAINER

(71) Applicant: La Prairie, Inc., New York, NY (US)

(72) Inventors: Anil Kalyanpur, Edison, NJ (US); Richard Suhr, Seaside Heights, NJ (US)

(73) Assignee: La Prairie, Inc., New York, NY (US)

( * ) Notice: Subject to any disclaimer, the term of this patent is extended or adjusted under 35 U.S.C. 154(b) by 0 days.

(21) Appl. No.: 13/886,215

(22) Filed: May 2, 2013

(65) Prior Publication Data

US 2014/0326273 A1 Nov. 6, 2014

(51) Int. Cl.

| | |
|---|---|
| ***A45D 40/24*** | (2006.01) |
| ***A45D 27/22*** | (2006.01) |
| ***B65D 43/14*** | (2006.01) |
| ***B65D 69/00*** | (2006.01) |
| ***B65D 71/00*** | (2006.01) |
| ***A45D 40/22*** | (2006.01) |
| ***A45D 33/00*** | (2006.01) |

(52) U.S. Cl.

CPC ..... *A45D 40/24* (2013.01); *A45D 33/008* (2013.01); *A45D 40/22* (2013.01)

(58) Field of Classification Search

CPC ..... A45D 33/22; A45D 33/24; A45D 33/26; A45D 40/22; A45D 40/221; A45D 40/24; A45D 40/18; A45D 33/003; A45D 33/006; A45D 33/008; A45D 33/025; A45D 33/16; A45D 33/18; A45D 33/20; B65D 25/04; B65D 5/66

USPC ..... 132/296, 286, 291, 294, 295, 298, 300, 132/301, 304, 305, 314, 315, 316; 206/581, 206/823, 92, 747–749, 45.23, 235; 220/810, 811, 814–822, 825, 826, 833, 220/834, 836, 843, 844, 848, 524, DIG. 26; 16/294, 365, 370

See application file for complete search history.

(56) References Cited

U.S. PATENT DOCUMENTS

| | | | | | |
|---|---|---|---|---|---|
| 1,249,641 | A | * | 12/1917 | Lefrancois | 220/521 |
| 1,360,739 | A | * | 11/1920 | Harman | 132/296 |
| 1,381,036 | A | | 6/1921 | Vericel | |
| 1,425,138 | A | * | 8/1922 | Roystone | 132/295 |
| RE15,564 | E | * | 3/1923 | Wilson | 132/295 |
| 1,455,432 | A | | 5/1923 | Dodson | |
| 1,460,906 | A | | 7/1923 | Hyde | |
| 1,481,403 | A | * | 1/1924 | Wilson | 132/296 |
| 1,485,052 | A | * | 2/1924 | Reutter | 220/504 |
| 1,497,905 | A | | 6/1924 | Hathaway | |
| 1,503,378 | A | * | 7/1924 | Reid | 132/296 |
| 1,513,860 | A | * | 11/1924 | Reutter | 220/4.22 |
| 1,518,594 | A | | 12/1924 | Marble | |
| 1,525,665 | A | | 2/1925 | Slover et al. | |
| 1,551,006 | A | * | 8/1925 | Bruns | 220/796 |
| 1,570,382 | A | | 1/1926 | Lyhne | |
| 1,583,120 | A | | 5/1926 | Brenner | |
| 1,601,892 | A | * | 10/1926 | Thralls | 132/296 |
| 1,618,598 | A | * | 2/1927 | Lyhne | 132/296 |

(Continued)

*Primary Examiner* — Vanitha Elgart

(74) *Attorney, Agent, or Firm* — Dentons US LLP

(57) ABSTRACT

The present disclosure is directed to a multi-compartment container with a number of separate compartments, each of which is opened by depressing a separate button. The compartments may be used to hold any number of things, including, solids, gels, pastes, cosmetics or any other non liquid substance. In the present disclosure, the compartments may be opened independently or simultaneously. In addition to containing the desired substance, each compartment also comprises a reflective surface or mirror.

24 Claims, 8 Drawing Sheets

(56) References Cited

U.S. PATENT DOCUMENTS

| | | | | | |
|---|---|---|---|---|---|
| 1,636,183 | A | | 7/1927 | Goertz | |
| 1,647,004 | A | * | 10/1927 | Hyde | 132/296 |
| 1,656,785 | A | * | 1/1928 | Foster | 206/86 |
| 1,761,615 | A | * | 6/1930 | Coryell | 132/296 |
| 1,792,030 | A | * | 2/1931 | Poranski | 132/296 |
| 1,841,933 | A | * | 1/1932 | Bowers | 132/296 |
| 2,196,017 | A | | 4/1940 | Kane | |
| 2,204,717 | A | * | 6/1940 | Younghusband | 132/296 |
| 2,389,788 | A | * | 11/1945 | Lathrop | 132/312 |
| 2,438,841 | A | | 3/1948 | Casalino | |
| 2,571,485 | A | | 10/1951 | Reiskin | |
| 2,712,318 | A | * | 7/1955 | Root | 132/301 |
| 3,256,892 | A | | 6/1966 | Esposito, Jr. | |
| 3,476,123 | A | * | 11/1969 | Flax | 132/315 |
| 4,696,317 | A | * | 9/1987 | Shioi et al. | 132/314 |
| 4,821,751 | A | * | 4/1989 | Chen | 132/295 |
| 5,025,817 | A | * | 6/1991 | Wen | 132/296 |
| 5,107,871 | A | | 4/1992 | Butcher et al. | |
| 5,542,561 | A | * | 8/1996 | Slink et al. | 220/291 |
| 5,638,957 | A | * | 6/1997 | Brasier | 206/581 |
| 5,735,297 | A | * | 4/1998 | Litton | 132/294 |
| 6,283,129 | B1 | | 9/2001 | Yuhura et al. | |
| 6,526,989 | B2 | | 3/2003 | Sheffler et al. | |
| 6,540,083 | B2 | * | 4/2003 | Shih | 206/581 |
| D479,366 | S | | 9/2003 | Goswell | |
| 6,681,780 | B1 | * | 1/2004 | Baxter | 132/295 |
| D523,177 | S | | 6/2006 | Ashiwa et al. | |
| D583,100 | S | | 12/2008 | Jackel | |
| D631,608 | S | | 1/2011 | Pires et al. | |
| 8,109,280 | B2 | | 2/2012 | Winckels et al. | |
| 8,540,115 | B2 | * | 9/2013 | Giraud et al. | 220/835 |
| 2002/0096448 | A1 | * | 7/2002 | Lee | 206/459.1 |
| 2003/0217761 | A1 | * | 11/2003 | Maelstaf | 132/294 |
| 2006/0005853 | A1 | * | 1/2006 | Shen | 132/296 |
| 2006/0226164 | A1 | | 10/2006 | Graham | |
| 2008/0173324 | A1 | * | 7/2008 | Washington | 132/295 |
| 2009/0308408 | A1 | | 12/2009 | Winckels et al. | |
| 2011/0048443 | A1 | | 3/2011 | Pires et al. | |
| 2012/0241468 | A1 | | 9/2012 | Deans | |
| 2014/0014131 | A1 | * | 1/2014 | Zhang | 132/316 |

* cited by examiner

MULTI-COMPARTMENT CONTAINER

TECHNICAL FIELD

The present invention relates to a multi-compartment container.

BACKGROUND OF THE INVENTION

Typically, containers having two compartments may include independent storage compartments that can hold various combinations of products such as fluids, powders, or pastes that are stored in a separated state until the user of a container decides to utilize any of the products. These types of containers typically only provide a single means for opening or closing either of the two compartments, which may render the containers cumbersome for use, especially with the risk of spillage of the contents of either compartment when both products of each compartment are accessible, but not necessarily desired for use. Additionally, existing two compartment containers are constructed with only a single mirror, again, making it awkward to use the products for application when a mirror is desired, since access to at least one product may always be hindered by the position of the mirror when it is located in the other compartment, Furthermore, as existing containers with two compartments typically require exposure of both products, the product not being used may be exposed for an unnecessary length of time and thus reduce the shelf life, usability, or effectiveness of the particular product.

SUMMARY

In an embodiment, a multi-layer container is disclosed. The container, comprising a first compartment configured for holding a first product, a second compartment configured for holding a second product, a first button, coupled to the first compartment, configured for opening the first compartment; and a second button, coupled to the second compartment, configured for opening the second compartment.

In another embodiment, the first compartment comprises at least one of a first polished surface and a first holding area for the first product. In another embodiment, the first polished surface is a mirror. In still another embodiment, the mirror is positioned on a top portion of the first compartment and the first holding area is positioned on a bottom portion of the first compartment.

In another embodiment, the second compartment comprises at least one of a second polished surface and a second holding area for the second product. In another embodiment, the second polished surface is a second mirror. In still another embodiment, the second mirror is positioned on a top portion of the second compartment and the second holding area is positioned on a bottom portion of the second compartment.

In another embodiment, the first compartment and the second compartment are coupled such that a bottom portion of the first compartment joins a top portion of the second compartment.

In another embodiment, the container further comprises a common latching mechanism that facilitates opening of the first compartment and the second compartment. In still another embodiment, the activation of the first button causes opening of the first compartment and activation of the second button causes opening of the second compartment. In still another embodiment, the first compartment may be opened irrespective of the second compartment and the second compartment may be opened irrespective of the first compartment. In still another embodiment, the first compartment and the second compartment may be simultaneously opened.

In an embodiment, the container further comprises a joining component for joining the first compartment and the second compartment, coupled between the first compartment and the second compartment. In another embodiment, the joining component further comprises a top surface with a reservoir and a bottom surface with a mirror. In another embodiment, a diameter of the joining component is greater than a diameter of the first compartment and the second compartment.

In an embodiment a single button can be used to open either one or the other compartment or both compartments. In another embodiment the location on the button where pressure is applied or the amount of pressure applied, i.e., how deep the button is pressed, is varied. In still another embodiment, the button may activate one or both compartments by sliding the button to a first side and then to a second side.

In another embodiment, the button may be activated by pressing, sliding (up/down or side to side), rotating, pulling and/or pushing, or a combinations of these.

BRIEF DESCRIPTION OF THE DRAWINGS

The present disclosure, in accordance with one or more embodiments, is described in detail with reference to the following figures. The drawings are provided for purposes of illustration only and merely depict typical or example embodiments. These drawings are provided to facilitate the reader's understanding of the apparatus and methods and shall not be considered limiting of the breadth, scope, or applicability of the invention. It should be noted that for clarity and ease of illustration these drawings are not necessarily made to scale.

Figure 1:
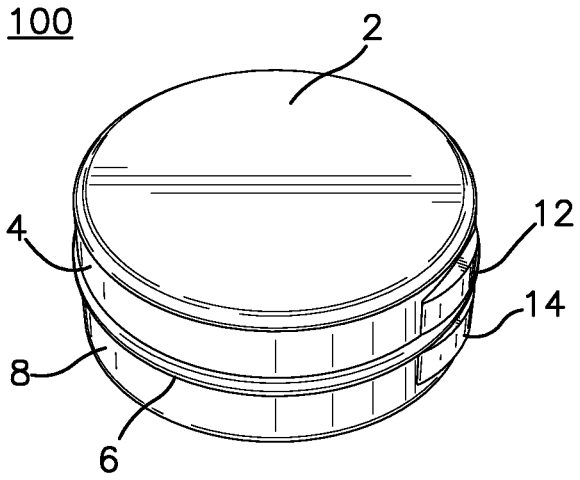
FIG. 1 is a drawing of perspective view of a multi-compartment container in accordance with an embodiment of the present disclosure.

Some of the figures included herein illustrate various embodiments from different viewing angles. Although the accompanying descriptive text may refer to such views as "top," "bottom" or "side" views, such references are merely descriptive and do not imply or require that all embodiments be implemented or used in a particular spatial orientation unless explicitly stated otherwise.

The figures are not intended to be exhaustive or to limit the embodiments to the precise form disclosed. It should be understood that the various embodiment can be practiced with modification and alteration, and that the invention is limited only by the claims and the equivalents thereof.

DETAILED DESCRIPTION

The embodiments described herein are exemplary. Descriptions in terms of these embodiments is provided to allow various features to be portrayed in the context of an exemplary application. As will be clear to one of ordinary skill in the art, the invention can be implemented in different and alternative embodiments without departing from the spirit or scope of the invention.

Unless defined otherwise, all terms used herein have the same meaning as is commonly understood by one of ordinary skill in the art to which this invention belongs.

A multi-part container of the present disclosure may have two or more compartments for holding similar or different materials. The materials may be powders, gels, liquids or creams. They may be dry materials, liquids or semi viscous materials. The materials may be the same or different. In an embodiment, cosmetics are stored in the different compartments. For example, in a first compartment, an eye makeup may be stored while in the second compartment a different color eye makeup or lip makeup may be stored. Similarly, any combination of cosmetics may be stored in such a container. The container may also be used for sunscreens, perfumes, hair products, or any other substances. In an embodiment, the compartments are released utilizing buttons. Each compartment is controlled by its own button and the depression of one button will not release the other compartment. This ensures that only the compartment intended to be open by the user is opened and prevents accidental spillage of the contents. In the present disclosure, reference is made to two-compartment containers, however, it is to be understood, that the present disclosure is not limited to only two compartments, and containers with three, four or five compartments are contemplated utilizing the present disclosure. In a two compartment container, containing two buttons, if both buttons are depressed, then both compartments can be opened and accessed at the same time.

Because of the unique multi-compartment design and the user's ability to open each compartment separately, in an embodiment, each compartment has its own mirror or reflective surface on the inside of the immediately adjacent lid so that when in the open position, the inside of the lid acts as a reflective surface or mirror to assist the user with applying the contents. Further, in this configuration, regardless of the compartment opened, the user does not need to open a second or subsequent compartment to access a mirror or reflective surface. In that way, the risk of cross contamination of materials in the compartments is reduced and the risk of spillage or leakage is reduced.

Figure 2:
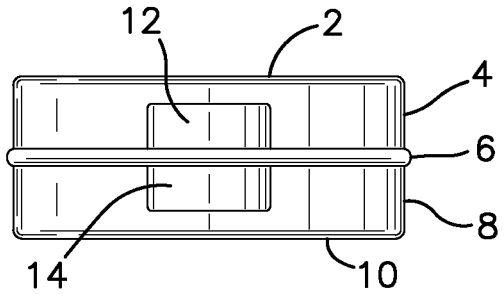
FIG. 2 is a drawing of a front view of a multi-compartment container in accordance with an embodiment of the present disclosure.

FIGS. 1 and 2 depict container 100 in accordance with the teachings of the present disclosure. Container 100 comprises top surface 2, a top or upper portion 4, a middle portion 6, a bottom portion 8 and a bottom surface 10, a first button 12, and a second button 14. First button 12 may be located on top portion 4 and controls the opening of top portion 4. Second button 14 may be located on bottom portion 8 below middle portion 6 and controls the opening of bottom portion 8. In an embodiment a logo, symbol, mark, or other design feature may be placed, embossed, or molded onto top surface 2 without effecting the opening and closing of the compartments. Additionally, and/or alternatively, upper and lower portions may be covered by a decorative shell made of metal, plastic, ceramic, or glass.

Container 100 may be round, square, octagonal, triangular or any other geometric shape. It may contain two compartments or may be multilayered. Container 100 may be made from plastic, metal, ceramic, glass, or any other rigid material. In an embodiment, top portion 4 may be opened by depressing button 12 and lifting in an upwardly direction. Middle portion 6 and bottom portion 8 will remain stationary and will not open when first button 12 is depressed thereby allowing a user access to the contents of the first compartment. Depressing second button 14 when top portion 4 is closed will allow the user to access the compartment in bottom portion 8. Depression of second button 14 will open bottom portion 8 and will not release or open top portion 4. In an embodiment, if both buttons 12 and 14 are depressed either simultaneously or in sequence, both compartments may be open, and depending on the positioning of middle portion 6 both compartments may be accessed.

In an embodiment a single button can be used to open either the top compartment or the bottom compartment or both. In another embodiment, one or both of buttons 12 and 14 may have specific locations on the button surface and be sensitive to pressure and the location on the buttons where pressure is applied or the amount of pressure applied, i.e., how deep the button is pressed, may open the compartments. In an embodiment, button 12 could release the top portion 4 exposing the compartment 20 on a first level of pressure or depression and the second compartment 30 when additional pressure or depression is applied. In still another embodiment, buttons 12 or 14 may activate one or both compartments 20 or 30 by sliding the button to a first position or a second position. That is, button 12 or 14 may open one or both compartments by sliding rather than pushing. For example, and not limitation, a single button 12 for example could be slid left to open the compartment 30 and right to open the compartment 20 or vice versa. In still another embodiment, the button may be activated by pressing, sliding (up/down or side to side), rotating, pulling and/or pushing, or a combinations of these.

Middle portion 6 separates the upper compartment from the lower compartment and may serve as the bottom of the top compartment and the top of the bottom compartment. Middle portion 6 may have a greater diameter than top portion 4 and bottom portion 8 such that it creates a rim or ridge that allows the user to hold container 100 in the middle. Middle portion 6 may also have the same diameter as top portion 4 or bottom portion 8 or both and blend into the container to create the visual impression of a single container.

Bottom surface 10 may be flat or may have a depression for the placement of a label, logo, or any other information that might be placed on the bottom of the container 100.

Figure 3A:
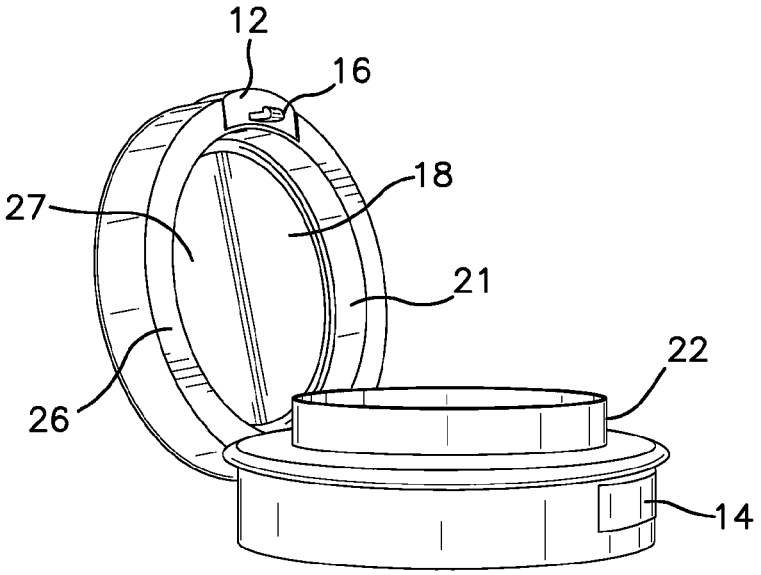
FIGS. 3*a-c* are drawings of perspective views of a multi-compartment container with the top compartment in a open position in accordance with an embodiment of the present disclosure.
Figure 3B:
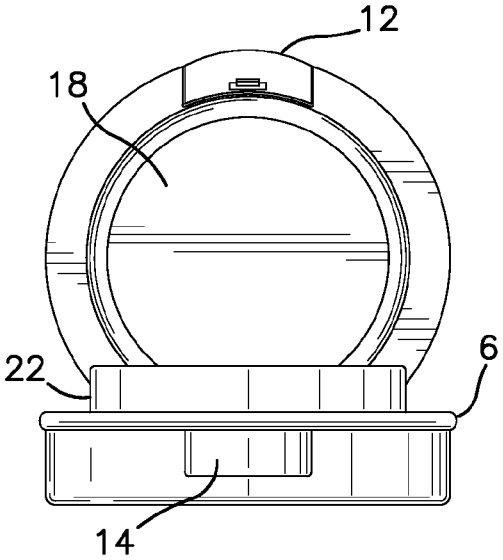
Figure 3C:
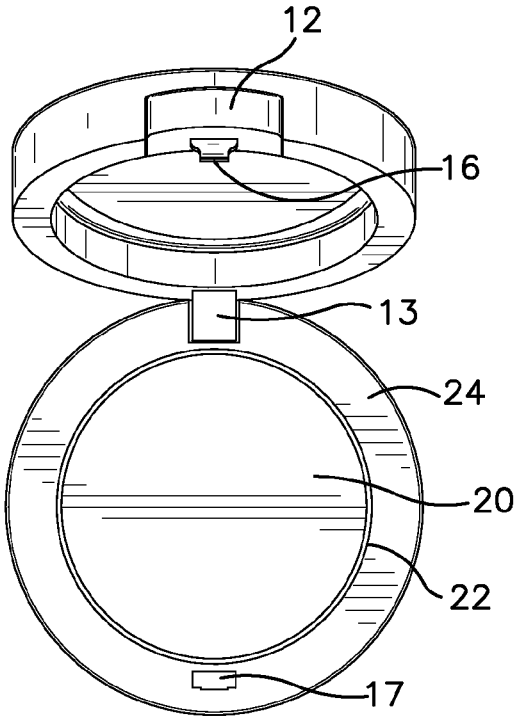

FIGS. 3*a-c* depicts container 100 in an open position with only top portion 4 in an open position and middle portion 6 in a closed position.

Container 100 may have hinge 13, top latch 16, latch slot 17, inner top surface 18, inner top perimeter 21, compartment 20, rim 22, lower ledge 24, and upper edge 26. Hinge 13 hingedly couples top portion 4 to middle portion 6 and allows top portion 4 to open to approximately 90 degrees with respect to middle portion 6. Top portion 4 may open to less than approximately 90 degrees or greater than approximately 90 degrees, such as, for example, to approximately 95 degrees, approximately 100 degrees, approximately 105 degrees, approximately 110 degrees, approximately 120 degrees, approximately 125 degrees, approximately 130 degrees, approximately 135 degrees, approximately 140 degrees, approximately 145 degrees, approximately 150 degrees, or greater than 150 degrees. Top portion 4 remains in a closed position until top button 12 is depressed releasing top latch 16 from latch slot 17. Top latch 16 may be any standard type latch that engages with latch slot 17. It may have a inverted lip, raised edge, bevel, tongs, or any other engagement mechanism to remain engaged with latch slot 17 until button 12 is depressed. Latch slot 17 is part of lower edge 24 and may penetrate lower edge 24 or may only penetrate partially therethrough. Rim 22 is integrated into middle portion 6 and encircles, in a surrounding configuration, compartment 20 or provides a perimeter for compartment 20 when compartment 20 is not of a circular configuration. Compartment 20 may be any shape, including, for example, triangular, square, rectangular, hexagonal, octagonal, or any other polygonal shape. Rim 22 is sized to fit within the cavity 27 formed by upper edge 26, inner top perimeter 21 and inner top surface 18, and is configured to be of a sufficient height to hold the desired material within the top portion 4. Compartment 20 is formed on the upper surface of middle portion 6 and is defined by rim 22. Compartment 20 bounded by rim 22 is sized to fit within the cavity 27, such that when container 100 is in a closed position, upper edge 26 rests on or adjacent to lower edge 24 and rim 22 sits within the cavity 27.

Inner top surface 18 may contain a reflective surface such as a mirror coating. Additionally and/or alternatively, a separate mirror may be inserted and coupled to inner top surface 18 using glue, chemical welding or any other bonding technique. Inner top surface 18 may also be polished, coated, or comprised of a material selected to create a highly reflective surface.

Figure 4A:
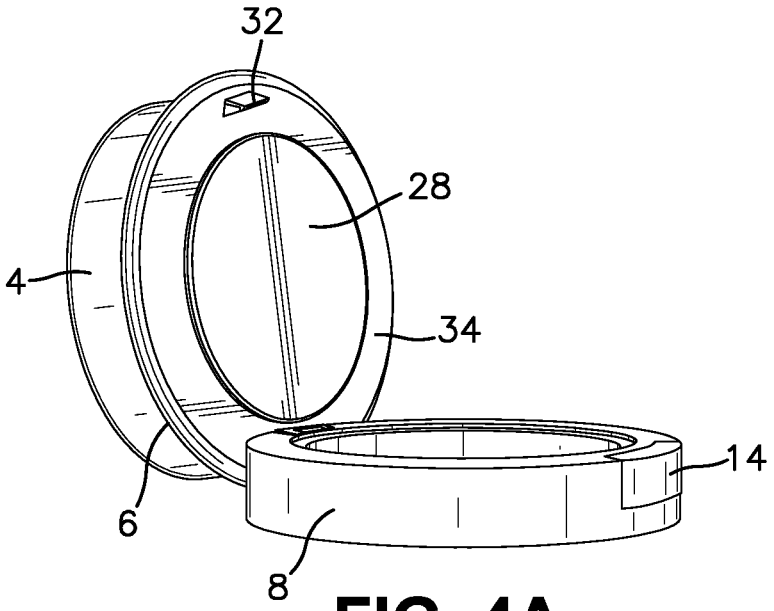
FIGS. 4*a-c* are drawings of perspective views of a multi-compartment container with the bottom compartment in an open position in accordance with an embodiment of the present disclosure.
Figure 4B:
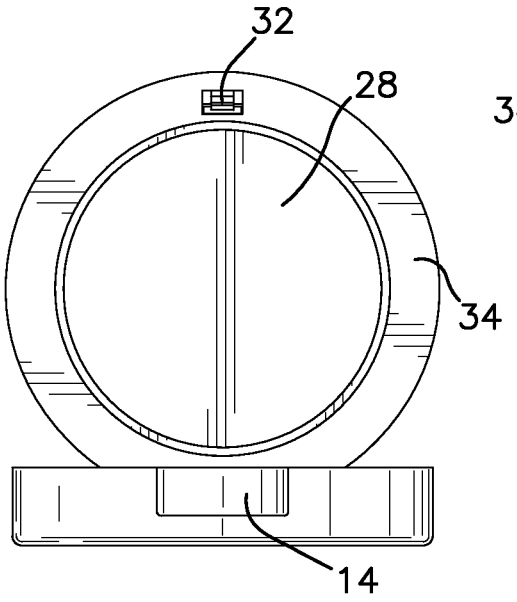
Figure 4C:
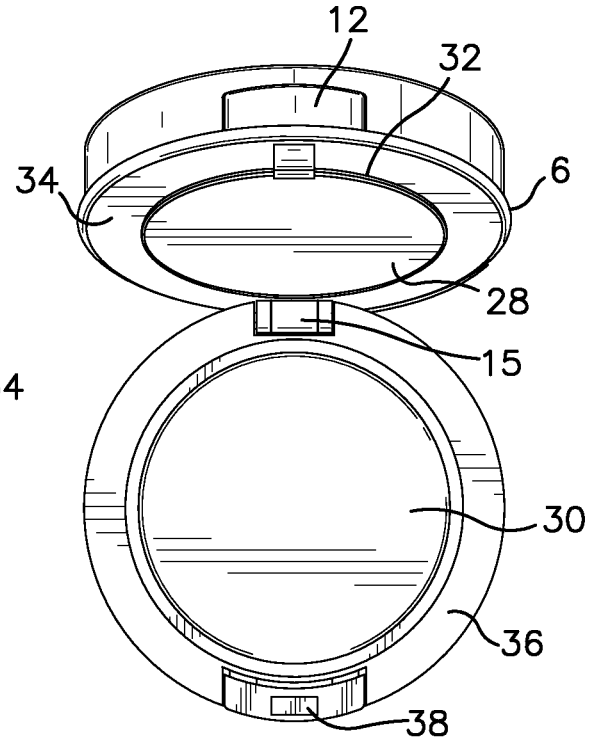

FIG. 4*a-c* depicts container 100 in a second open position exposing bottom portion 8. Container 100 contains second hinge 15 that straddles hinge 13, middle lower surface 28, lower compartment 30, middle latch 32, middle lower edge 34, bottom upper edge 36 and bottom latch slot 38.

In an embodiment, top latch 16 and middle latch 32 can be modified to move and/or latch in a lateral direction and are not limited to an up and down direction. For example, in an embodiment, depressing button 12 or 14 may cause the top latch 16 or the middle latch 32 to move horizontally and release from latch slot 17 or bottom latch slot 38. Furthermore, in an embodiment, a rotating button 12 or 14 may disengage top latch 16 or middle latch 32 by rotating to a groove or notch position.

Second hinge 15 hingedly connects bottom portion 8 to middle portion 6. Hinge 15 may surround hinge 13 or be adjacent to hinge 13 but operates independently from hinge 13 and is capable of rotating sufficiently to allow top and middle portions 4 and 6 to be placed approximately 90 degrees with respect to bottom portion 8. Top and middle portions 4 and 6 may open to less than approximately 90 degrees or greater than approximately 90 degrees with respect to bottom portion 8, such as, for example, to approximately 95 degrees, approximately 100 degrees, approximately 105 degrees, approximately 110 degrees, approximately 120 degrees, approximately 125 degrees, approximately 130 degrees, approximately 135 degrees, approximately 140 degrees, approximately 145 degrees, approximately 150 degrees, or greater than 150 degrees. Middle lower surface 28 may be reflective so as to act as a mirror for the user or may be a separate mirror coupled to middle portion 6 by adhesive, welding, bonding, or any other technique. Middle lower surface 28 is shaped to fit within the diameter of lower compartment 30 thereby allowing middle lower edge 34 to rest on top of or adjacent to bottom edge 36 when the bottom portion 8 is in a closed position. Lower compartment 30 is configured to be sufficiently deep to hold the substance placed in the bottom portion 8.

Middle latch 32 is controlled by second button 14 and extends from middle lower edge 34. Middle latch 32 may be aligned with top latch 16 or may be offset from top latch 16. Middle latch 32 releasably engages with bottom latch slot 38 to retain bottom portion 8 in a closed position until second button 14 is depressed. Middle latch 32 may contain a bevel, tongue, a lip or any other type of engagement means to engage and be held within bottom latch slot 38 in a closed position.

Figure 5A:
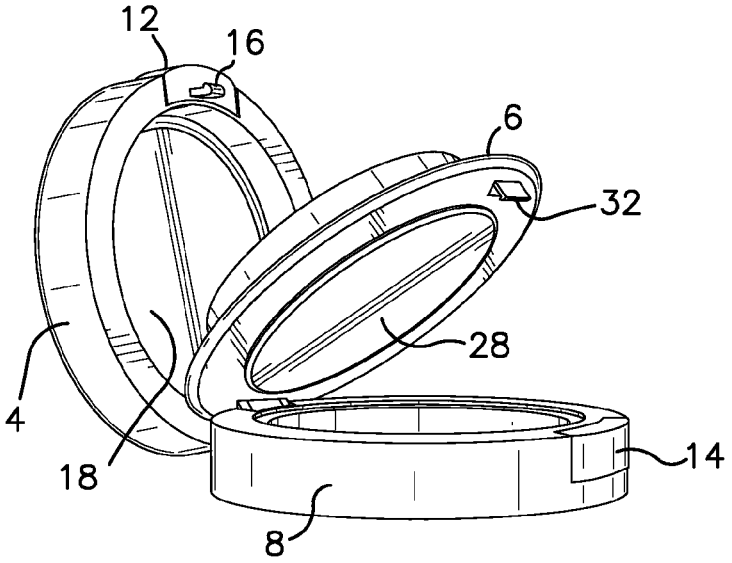
FIGS. 5*a-c* are drawings of perspective views of a multi-compartment container with both the top compartment and the bottom compartment in partially open positions showing both compartments in accordance with an embodiment of the present disclosure.
Figure 5B:
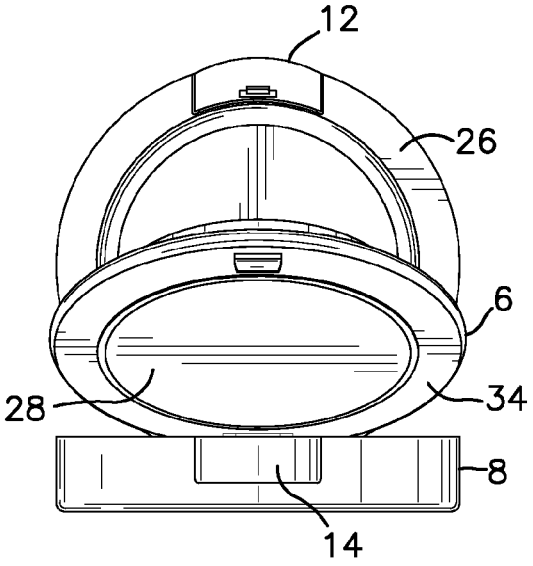
Figure 5C:
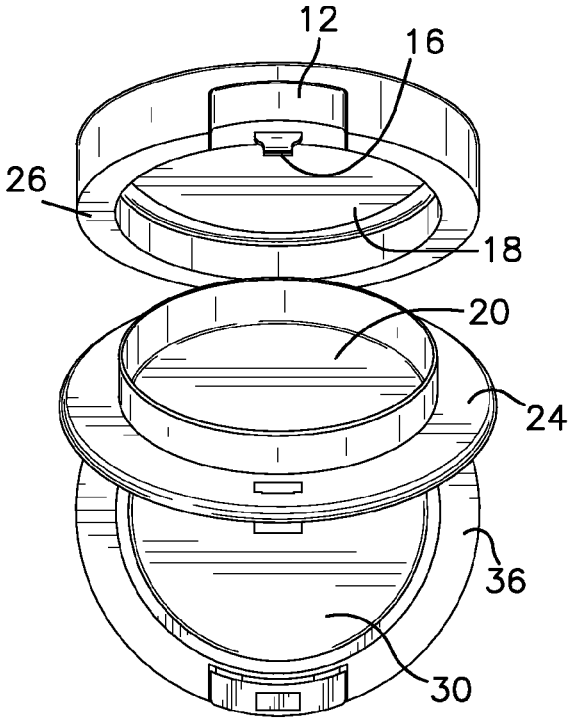

FIGS. 5*a-c* depict container 100 with both the top portion 4 and bottom portion 8 in open position. While typically in operation, top portion 4 or bottom portion 8 would be open one at a time, allowing access to compartment 20 and lower compartment 30 respectively, there is no reason that both compartments may not be open simultaneously with middle portion 6 separating the two.

As seen in FIG. 5*a* container 100 may have two mirrored surfaces, inner top surface 18 and middle lower surface 28. Similarly, as seen in FIG. 5*c*, container 100 presents a user with two compartments, compartment 20 and lower compartment 30, each of which is capable of containing a powder, liquid, or gel. Middle portion 6 may move freely on hinge 15 to allow a user to access either compartment without having to fully close the unused compartment at the time.

Figure 6A:
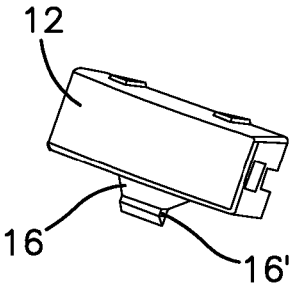
FIGS. 6*a-c* are drawings of an upper button in accordance with an embodiment of the present disclosure.
Figure 6B:
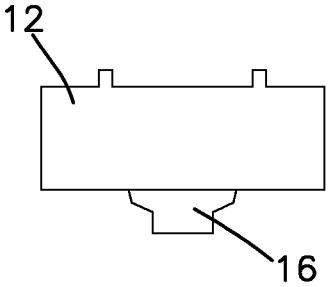
Figure 6C:
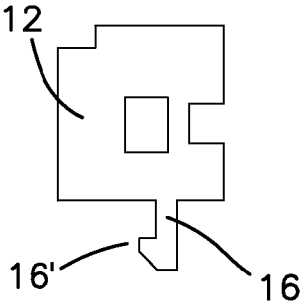
Figure 7A:
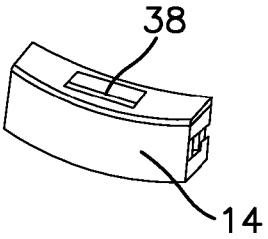
FIGS. 7*a-b* are drawings of a second button in accordance with an embodiment of the present disclosure.
Figure 7B:
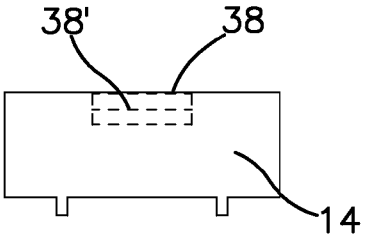

FIGS. 6*a-c* depict, in an embodiment, button 12 comprising top latch 16 and lip 16'. FIGS. 7*a-c* depict, in an embodiment, second button 14 comprising bottom latch slot 38. Top latch 16 is an integral part of button 12 and middle latch 32 is an integral part of middle portion 6 (See FIGS. 10*a* and 11). Similarly, latch slot 17 as seen in FIG. 10*b* which is intended to engage with top latch 16 is incorporated into middle portion 6 on lower ledge 24 while bottom latch slot 38 is integrated into second button 14. In this configuration, the lip 16', which may be beveled, on top latch 16 is facing in an outward direction and the lip 32', which may be beveled, on middle latch 32 is oriented in an inward direction.

In an embodiment, the depression of button 12 causes top latch 16 to move inwardly and causes the lip 16' of top latch 16 to disengage from latch slot 17. Likewise, in an embodiment, the depression of second button 14 cause bottom latch slot 38 to move in an inward direction, thereby disengaging itself from lip 32' of middle latch 32.

Figure 8:
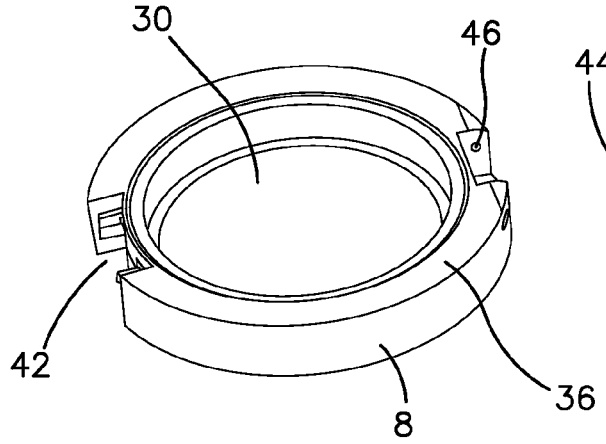
FIG. 8 is a drawing of a bottom portion of a multi-layer container in accordance with an embodiment of the present disclosure.

FIG. 8 depicts a detailed view of bottom portion 8 in an embodiment. Bottom portion 8 contains hinge notch 46 for insertion of second hinge 15 so at to allow nesting of second hinge 15 and hinge 13 with hinge slot 46. Button notch 42 is sized to house second button 14, which may be press fit, or placed in grooves and may contain a spring mechanism to maintain positive pressure on second button 14 with respect to button notch 42.

Figure 9:
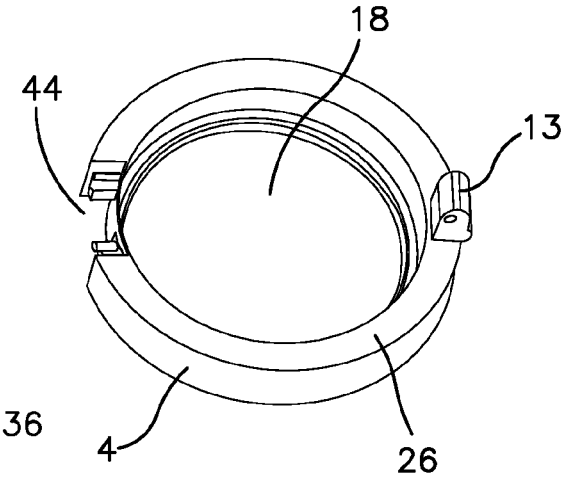
FIG. 9 is a drawing of a top portion of a multi-layer container in accordance with an embodiment of the present disclosure.

FIG. 9 depicts a detailed view of upper portion 4 comprising hinge 13 and top button notch 44. Hinge 13 may be molded into surface 26 or may be secured in place using adhesives or other chemical or thermal bonding. Hinge 13 is sized to fit within hinge opening 15' which is located within second hinge 15. In this manner hinge 13 and second hinge 15 are nested but operate independently. Button notch 44 is sized to receive first button 12.

Figure 10A:
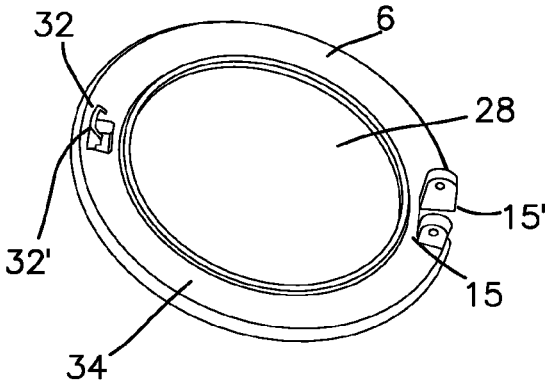
FIGS. 10*a-b* are drawings of a middle portion of a multi-layer container in accordance with an embodiment of the present disclosure.
Figure 10B:
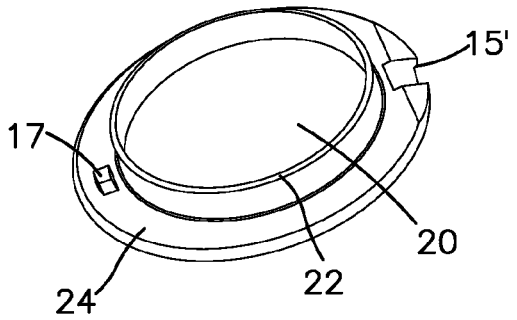

FIGS. 10*a* and 10*b* depict middle portion 6. In an embodiment, second hinge 15 is molded onto middle lower edge 34, but it may be separate and coupled to middle lower edge 34 using any known method, including, for example, adhesives or chemical or thermal bonding. Middle lower edge 34 also contains middle latch 32 opposite second hinge 15. Latch slot 17 is located on lower ledge 24 which also comprises rim 22, and compartment 20. Hinge opening 15' is sized to allow hinge 13 to nest within the opening.

Figure 11:
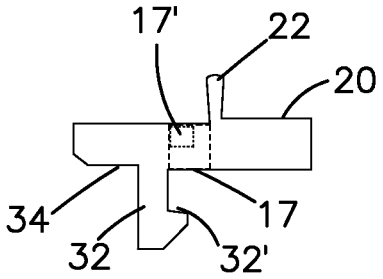
FIG. 11 is a drawing of a latch on a middle portion of a container in accordance with an embodiment of the present disclosure.
Figure 12:
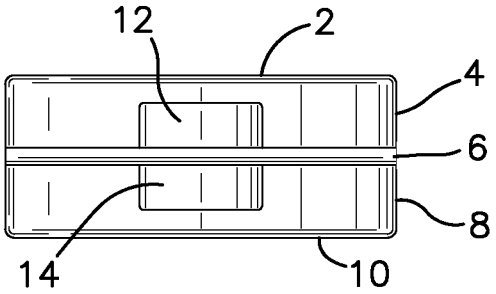
FIG. 12 is a drawing of a front view of a multi-compartment container in accordance with an embodiment of the present disclosure.

FIG. 11 depicts a profile drawing of a portion of middle portion 6. FIG. 11 shows middle latch 32, lip 32', latch slot 17, compartment 20, rim 22, and middle lower edge 34. As seen, lip 32' when inserted in bottom latch slot 38 will engage with a corresponding ridge 38' which will maintain the bottom portion in a closed position until second button 14 is depressed, causing ridge 38' to move in a rearward direction thereby disengaging from lip 32'. Similarly, top latch 16 when inserted into latch slot 17 may engage with a ridge 17' which can be located at the upper edge of middle latch 32 furthest from rim 32'. Conversely, when button 12 is depressed, top latch 16 and rim 16' move in a rearward direction, thereby disengaging them from latch slot 17 which is stationary. In this manner, each latch may be released separately so that each compartment may be opened independent of the other.

Those skilled in the art will recognize that the present teachings are amenable to a variety of modifications and/or enhancements. For example, although the implementation of various latch components described above may be embodied as described, they may also be arranged in different embodiments, where for example, top latch 16 and middle latch 32 are arranged in opposite directions, i.e., both facing upwardly or one up and one down. While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

The invention claimed is:

1. A container, comprising:

a top portion comprising a cavity;

a bottom portion comprising a first compartment configured for holding a first product;

a separating component comprising a platform and a second compartment for holding a second product, the platform configured for separating the top portion and the bottom portion, wherein the diameter of the platform is equal to or greater than the diameter of at least one of the top portion and the bottom portion at all points along the perimeter of the platform, and wherein the second compartment is configured to fit within the cavity;

wherein the top portion is coupled to the bottom via a first portion hinge having an axis of rotation and the separating component is coupled to the bottom portion via a second hinge; and wherein the top portion and the bottom portion move independently about the axis of rotation.

2. The container of claim 1, wherein the top portion further comprises at least one of a first reflective surface positioned within the cavity.

3. The container of claim 2 where the first reflective surface is a mirror.

4. The container of claim 3, wherein the mirror is positioned at a bottom surface of the top portion within the cavity.

5. The container of claim 1, wherein the separating component further comprises at least one of a second reflective surface.

6. The container of claim 5 wherein the second reflective surface is a second mirror.

7. The container of claim 6, wherein the second mirror is positioned on a bottom surface of the separating component.

8. The container of claim 1, further comprising a first button, coupled to the top portion, configured for opening the top portion and;

a second button, coupled to the bottom portion, configured for opening the bottom portion;

wherein the first button and the second button are depressible.

9. The container of claim 1, further comprising:

a common latching mechanism that facilitates opening of the top portion and the bottom portion.

10. The container of claim 8, wherein activation of the first button enables opening of the top portion and activation of the second button enables opening of the bottom portion.

11. The container of claim 1, wherein the first compartment is accessable independently of the second compartment and the second compartment is accessible independently of the first compartment.

12. The container of claim 1, wherein the first compartment and the second compartment may be simultaneously accessed.

13. The container of claim 1, wherein top portion comprises at least a first reflective surface and the separating component comprises at least a second reflective surface.

14. A container, comprising:

a first compartment having a first reflective surface;

a second compartment configured for holding a first product;

a separating component for separating the first compartment and the second compartment, wherein the diameter of the separating component is equal to or greater than the diameter of at least one of the first compartment and the second compartment at all points along the perimeter of such compartment, said separating component further comprising a third compartment and a reflective surface;

a button, coupled to at least one of the first compartment and the second compartment, configured for opening at least one of the first compartment and the second compartment; and wherein the first compartment is hingedly coupled to the second compartment and the separating component is hingedly coupled to the second compartment.

15. The container of claim 14, where the first reflective surface is a mirror.

16. The container of claim 15, wherein the mirror is positioned at a top portion of the first compartment.

17. The container of claim 14, wherein the second reflective surface is a second mirror.

18. The container of claim 17, wherein the second mirror is positioned at a bottom portion of the separating component.

19. The container of claim 14, wherein the first compartment and the second compartment are coupled such that a bottom portion of the said separating compartment abuts, forms or acts as a top portion of the second compartment.

20. The container of claim 14, further comprising:

a common latching mechanism that facilitates opening of the first compartment and the second compartment.

21. The container of claim 14, wherein the button is a first button and further comprising a second button, and wherein activation of the first button enables accessing of the first compartment and activation of the second button enables accessing of the second compartment.

22. The container of claim 14, wherein the button is configured for accessing of the first compartment and the second compartment.

23. The container of claim 14, wherein the third compartment comprises a reservoir.

24. A container comprising:

a top portion comprising a cavity and a first latch;

a bottom portion comprising a first compartment and a first latch slot wherein the bottom portion is configured for holding a first product;

a separating component comprising a platform, a second compartment for holding a second product, a second latch, and a second latch slot, the platform configured for separating the top portion and the bottom portion, wherein the second compartment is configured to fit within the cavity; and wherein the top portion is coupled to the bottom portion via a first hinge having an axis of rotation and the separating component is coupled to the bottom portion via a second hinge;

wherein the first latch couples to the second latch slot and the second latch couples to the first latch slot; and wherein the top portion and the bottom portion move independently about the axis of rotation.

* * * * *